US010344746B2

(12) United States Patent
Jung et al.

(10) Patent No.: US 10,344,746 B2
(45) Date of Patent: Jul. 9, 2019

(54) HYDRAULIC DOUBLE-ACTING HAND PUMP

(71) Applicant: YKMC, INC., Asan-si (KR)

(72) Inventors: Chan Jo Jung, Bucheon-si (KR); Kwan Seop Jang, Seoul (KR); Do Sub Jang, Seoul (KR)

(73) Assignee: YKMC, INC., Asan-si (KR)

( * ) Notice: Subject to any disclaimer, the term of this patent is extended or adjusted under 35 U.S.C. 154(b) by 314 days.

(21) Appl. No.: 15/147,199

(22) Filed: May 5, 2016

(65) Prior Publication Data

US 2016/0341186 A1 Nov. 24, 2016

(30) Foreign Application Priority Data

May 20, 2015 (KR) ..... 10-2015-0070582

(51) Int. Cl.

| | |
|---|---|
| ***F04B 5/02*** | (2006.01) |
| ***F04B 1/02*** | (2006.01) |
| ***F04B 5/00*** | (2006.01) |
| ***F04B 9/14*** | (2006.01) |
| ***F04B 17/06*** | (2006.01) |
| ***F04B 23/02*** | (2006.01) |
| ***F04B 23/06*** | (2006.01) |
| ***F04B 39/10*** | (2006.01) |
| ***F04B 41/02*** | (2006.01) |

(Continued)

(52) U.S. Cl.

CPC ..... *F04B 9/14* (2013.01); *F04B 1/02* (2013.01); *F04B 5/00* (2013.01); *F04B 17/06* (2013.01); *F04B 23/028* (2013.01); *F04B 23/06* (2013.01); *F04B 39/1006* (2013.01); *F04B 39/1046* (2013.01); *F04B 41/02* (2013.01); *F04B 49/22* (2013.01); *F04B 53/10* (2013.01); *F04B 53/162* (2013.01); *F04B 5/02* (2013.01)

(58) Field of Classification Search

CPC .... F04B 9/14; F04B 17/06; F04B 5/00; F04B 23/025; F04B 23/026; F04B 23/028; F04B 39/1006; F04B 39/1046; F04B 5/02

See application file for complete search history.

(56) References Cited

U.S. PATENT DOCUMENTS 806,617 A * 12/1905 Foley ..... B41F 27/1231 101/415.1
1,662,720 A * 3/1928 Sanchez ..... F04B 1/02 417/536

(Continued)

*Primary Examiner* — Bryan M Lettman
*Assistant Examiner* — Timothy P Solak
(74) *Attorney, Agent, or Firm* — Weiss & Moy, P.C.; Jeffrey D. Moy

(57) ABSTRACT

The present invention is directed to a hydraulic double-acting hand pump in which a high and low pressure side fluid supply grooves are formed in a top surface, a fluid inlet is formed in a bottom surface, a body in which the fluid outlet is formed in a side surface is provided, a piston is inserted into and coupled to the high and low pressure side fluid supply grooves, an upper end of the piston is connected and fixed to a handle rotatably installed in the low pressure side fluid supply groove of the body, the piston alternately and repeatedly ascends and descends to supply fluids to the high and low pressure side fluid supply grooves, and the fluids are discharged through the fluid outlet of the body by pushing the fluids inside the high and low pressure side fluid supply grooves.

3 Claims, 7 Drawing Sheets

(51) Int. Cl.

| | |
|---|---|
| ***F04B 49/22*** | (2006.01) |
| ***F04B 53/10*** | (2006.01) |
| ***F04B 53/16*** | (2006.01) |

(56) References Cited

U.S. PATENT DOCUMENTS

| | | | | | |
|---|---|---|---|---|---|
| 2,776,624 | A | * | 1/1957 | Reinhard | B66F 3/42 417/429 |
| 2,820,415 | A | * | 1/1958 | Born | B66F 3/42 137/87.03 |
| 3,006,281 | A | * | 10/1961 | Delaney | B66F 3/42 417/285 |

* cited by examiner

HYDRAULIC DOUBLE-ACTING HAND PUMP

CROSS-REFERENCE TO RELATED APPLICATION

This application claims priority to and the benefit of Korean Patent Application No. 10-2015-0070582, filed on May 20, 2015, the disclosure of which is incorporated herein by reference in its entirety.

BACKGROUND

1. Field of the Invention

The present invention relates to a hand pump, and more particularly, to a hydraulic double-acting hand pump in which a pair of pistons installed in high and low pressure side fluid supply grooves alternatively ascend and descend, and fluids in the high and low pressure side fluid supply grooves are discharged to the outside of a body.

2. Discussion of Related Art

Generally, a pump is a device which transfers fluids through a pipe using a pressure effect or forcibly transfers fluids inside a low pressure container into a high pressure container through a pipe.

Here, in addition to water, the pump is also used in transferring special fluids including oil, chemical, or pulp, viscose, etc.

Here, the pump includes a discharge valve and a suction valve therein, and due to a reciprocating motion of the piston, the discharge valve and the suction valve are alternatively opened and closed to discharge and suction liquid.

Patent document KR10-0199658 B1 shows a conventional reciprocating electronic pump. Referring to the Patent document 1, the conventional reciprocating electronic pump includes a cylinder in a hollow shape, a piston which is installed in the cylinder and laterally moves in a reciprocating manner, a solenoid which is installed to surround an outer circumferential surface of the cylinder and provides a magnetic force to the piston, suction pipes which supply fluids to the cylinder through both ends of the cylinder, and a discharge pipe which discharges the fluids in the cylinder to the outside of the cylinder.

Here, when the piston is moved toward the left in the cylinder by the magnetic force of the solenoid, fluids remaining in space on the left in the cylinder are discharged to the outside through the discharge pipe formed on the left thereof, and at this point, fluids are supplied through the suction pipe formed on the right thereof to be supplied to space on the right in the cylinder.

Next, when the piston is moved toward the right in the cylinder by the same method as described above, the fluids remaining in space on the right in the cylinder are pushed by the piston and discharged to the outside of the cylinder through the discharge pipe formed on the right.

At this point, the fluids are supplied to the space on the left in the cylinder through the suction pipe formed on the left.

That is, the piston is laterally moved in a reciprocating manner in the cylinder by the solenoid to push the fluids inside the cylinder to the outside and at this point, forcibly suctions fluids into the cylinder.

However, in a patent document such as the above Patent document 1, an external influence on the magnetic force between the solenoid and the piston causes the piston not to properly perform reciprocating motions, speed of the reciprocating motion is changed according to the variation of the pressures of the suction pipe and the discharge pipe, an operation of the piston stops when the pressure in the cylinder is raised higher than the magnetic force of the solenoid, and thus there is a problem in that the reliability of a product is degraded because the fluid suction and discharging are not performed due to the inoperability of the piston.

SUMMARY OF THE INVENTION

The present invention is directed to a hydraulic double-acting hand pump in which low pressure side fluid supply grooves are formed in a top surface, high pressure side fluid supply grooves are respectively formed under the low pressure side fluid supply grooves, a fluid inlet which communicates with the high pressure side fluid supply grooves and the low pressure side fluid supply grooves is formed in a bottom surface, a body in which the fluid outlet is formed in a side surface is provided, an ascending/descending piston is inserted into and coupled to the high pressure side fluid supply groove and the low pressure side fluid supply groove, an upper end of the piston is connected and fixed to a handle rotatably installed between the low pressure side fluid supply grooves of the body, and by alternately and repeatedly pumping the piston using the handle, the piston alternately and repeatedly ascends and descends to supply fluids to the high and low pressure side fluid supply grooves, and pushes the fluids in the high and low pressure side fluid supply grooves to discharges the fluids through the fluid outlet of the body.

The present invention is also directed to a hydraulic double-acting hand pump which, when a pressure in the low pressure side fluid supply groove is raised while a piston is uniformly pushing the fluids in the high and low pressure side fluid supply grooves, discharges fluids in the low pressure side fluid supply groove to the outside through a bypass path, and at this point, sequentially pushes fluids inside the high pressure side fluid supply grooves to discharge the fluids to a fluid outlet.

According to an aspect of the present invention, there is provided a hydraulic double-acting hand pump which includes a body installed on a top surface of a storage tank, wherein a pair of low pressure side fluid supply grooves which receive fluids are formed to be recessed in a top surface of the body to face each other, high pressure side fluid supply grooves in communication with the low pressure side fluid supply groove are respectively formed under the low pressure side fluid supply grooves to have a smaller diameter than a diameter of the low pressure side fluid supply groove, a fluid inlet is formed on a bottom surface of the body and communicates with the high and low pressure side fluid supply grooves to receive fluids from the storage tank and to supply the fluids to the high and low pressure side fluid supply grooves, and at least one fluid outlet in communication with the high and low pressure side fluid supply grooves is formed at one side surface or both side surfaces of the body to guide the fluids inside the high and low pressure side fluid supply grooves to be discharged to the outside; pistons which are inserted into and coupled to the high and low pressure side fluid supply grooves and ascend and descend along the high and low pressure side fluid supply grooves to supply fluids to the high and low pressure side fluid supply grooves or pushes fluids inside the high and low pressure side fluid supply grooves to the fluid outlet; and a handle in a rod shape which is rotatably installed between the low pressure side fluid supply grooves of the body, wherein an outer surface coupled to the piston to alternately and repeatedly pump the pistons.

In the hydraulic double-acting hand pump, the body may include a fluid guide path formed to horizontally penetrate in a direction from one surface to the other surface of the body and to perpendicularly communicate with the fluid inlet, a low pressure side fluid guide path formed between the low pressure side fluid supply groove and the fluid guide path to guide fluids inside the fluid guide path to the low pressure side fluid supply groove, and a high pressure side fluid guide path formed between the high pressure side fluid supply groove and the fluid guide path to guide fluids inside the fluid guide path to the high pressure side fluid supply groove.

In the hydraulic double-acting hand pump, the body may further include a bypass outlet formed at a bottom surface of the body, a bypass path formed between the bypass outlet and the low pressure side fluid supply groove to guide fluids inside the low pressure side fluid supply groove to the bypass outlet, and a relief valve installed in the bypass outlet and configured to be opened to discharge fluids to the outside of the body through the bypass outlet when a pressure in the low pressure side fluid supply groove is increased more than a predetermined pressure.

In the hydraulic double-acting hand pump, the body may further include a fluid flow controller which is formed between the fluid guide path and the fluid outlet to communicate with the high and low pressure side fluid guide paths, and supplies fluids to the high and low pressure side fluid guide paths or guides fluids discharged from the high and low pressure side fluid supply grooves through the high and low pressure side fluid guide paths to be discharged through the fluid outlet.

In the hydraulic double-acting hand pump, the fluid flow controller may include a first flow path through which the fluid guide path and the high and low pressure side fluid guide paths communicate with each other; a second flow path through which the first flow path and the fluid outlet communicate with each other; a blocking ball which is inserted into the first flow path and opens and closes the first flow path; and an elastic spring which is inserted into the second flow path and presses the blocking ball such that the blocking ball seals the first flow path.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
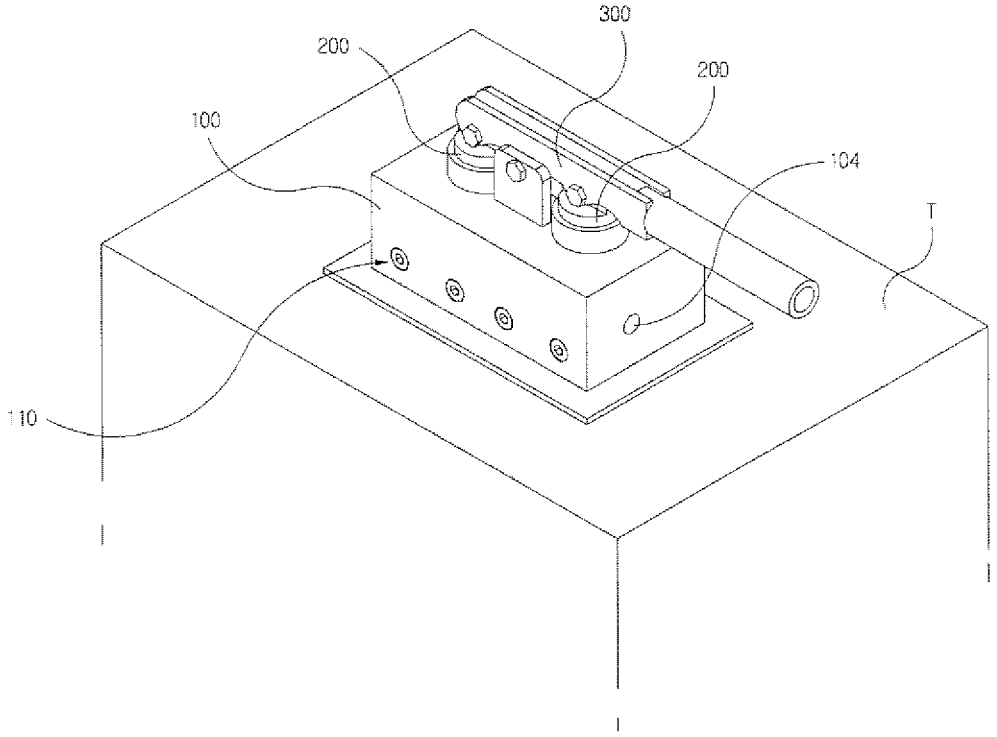
FIG. 1 is a perspective view illustrating a hydraulic double-acting hand pump according to an embodiment of the present invention.
Figure 2:
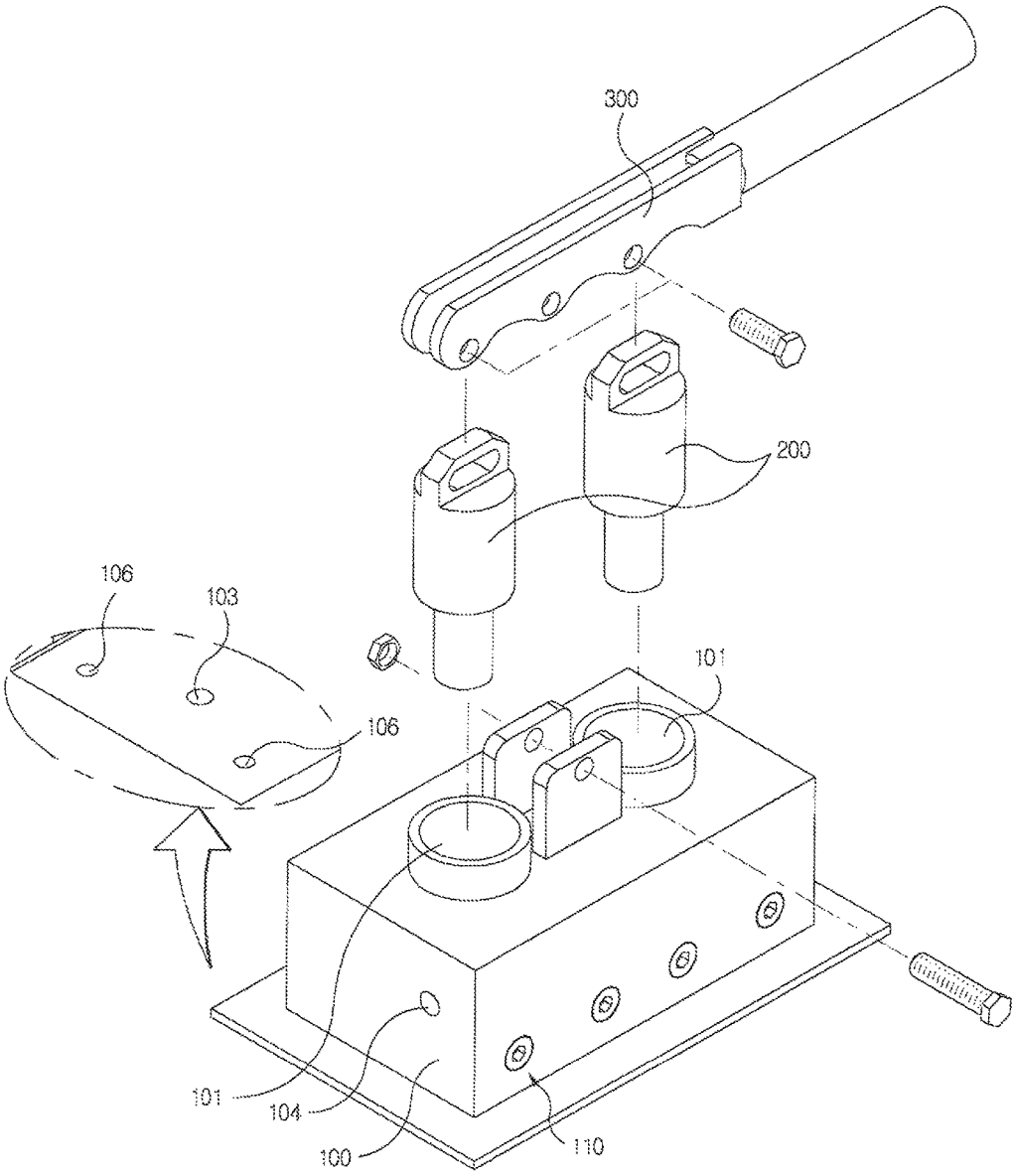
FIG. 2 is an exploded perspective view of the hydraulic double-acting hand pump shown in FIG. 1.
Figure 3A:
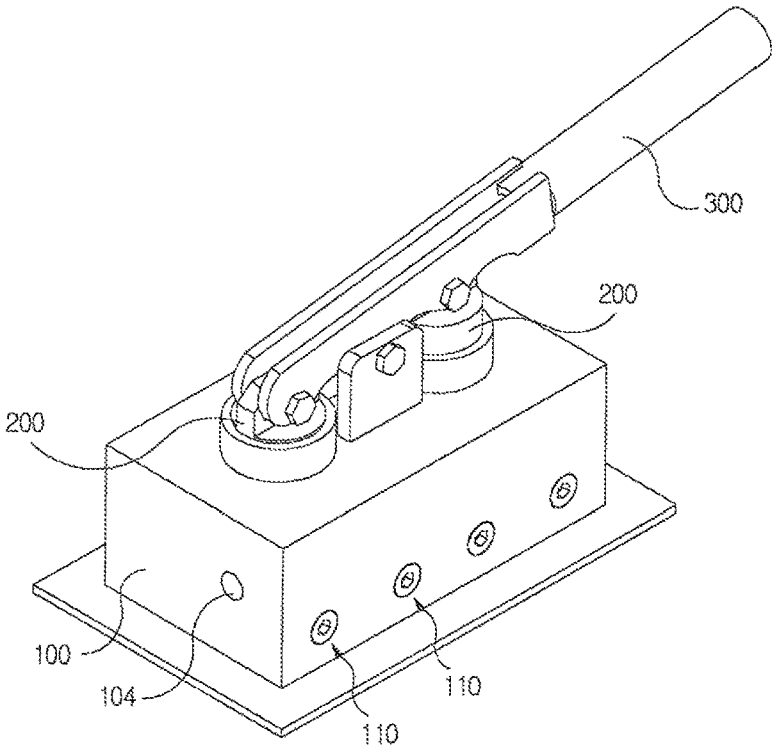
FIGS. 3*a* and 3*b* are perspective views illustrating operating states of the hydraulic double-acting hand pump according to the embodiment of the present invention.
Figure 3B:
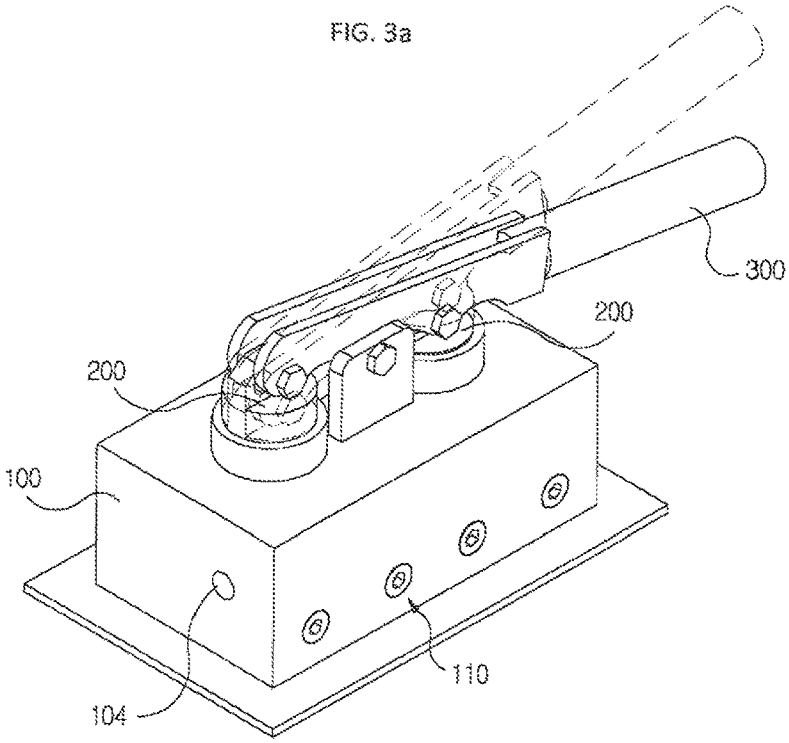

Hereinafter, an exemplary embodiment of the present invention will be described in more detail with reference to following drawings.

Referring to FIGS. 1 to 3*b*, a body 100 is installed on a top surface of the storage tank T, a pair of low pressure side fluid supply grooves 101 which receive fluids are formed to be recessed in a top surface of the body 100 to face each other, high pressure side fluid supply grooves 102 formed to have a smaller diameter than a diameter of the low pressure side fluid supply groove 101 and in communication with the low pressure side fluid supply grooves 101 are respectively formed under the low pressure side fluid supply grooves 101, a fluid inlet 103 in communication with the high and low pressure side fluid supply grooves 102 and 101 to receive fluids from the storage tank T to supply the fluids to the high and low pressure side fluid supply grooves 102 and 101, is formed in a bottom surface, and at least one fluid outlet 104 in communication with the high and low pressure side fluid supply grooves 102 and 101 to guide the fluids in the high and low pressure side fluid supply grooves 102 and 101 to be discharged to the outside is formed at one side surface or both side surfaces of the body 100.

The body 100 receives fluids from the fluid inlet 103 and supplies the fluids to the high and low pressure side fluid supply grooves 102 and 101.

The body 100 receives fluids from each of the high low pressure side fluid supply grooves 102 and 101.

The high and low pressure side fluid supply grooves 102 and 101 generate a suction pressure and a pressurizing pressure therein using ascending/descending pistons 200.

In the body 100, when a suction pressure which suctions fluids is generated at one groove of the high and low pressure side fluid supply grooves 102 and 101, a pressurizing pressure which pushes fluids is generated at the other groove of the high and low pressure side fluid supply grooves 102 and 101.

In the body 100, a fluid guide path 105 is formed to horizontally penetrate in a direction from one surface to the other surface thereof to perpendicularly communicate with the fluid inlet 103, a low pressure side fluid guide path 101*a* is formed between the low pressure side fluid supply groove 101 and the fluid guide path 105 to guide fluids inside the fluid guide path 105 to the low pressure side fluid supply groove 101, and a high pressure side fluid guide path 102*a* is formed between the high pressure side fluid supply groove 102 and the fluid guide path 105 to guide fluids inside the fluid guide path 105 to the high pressure side fluid supply groove 102.

Both ends of the fluid guide path 105 is blocked with blocking members (not shown) to prevent a leakage of fluids.

In the body 100, bypass outlets 106 are formed at a bottom surface thereof, a bypass path 106*a* is formed between the bypass outlet 106 and the low pressure side fluid supply groove 101 to guide fluids inside the low pressure side fluid supply groove 101 to the bypass outlet 106, and a relief valve 107 is further installed in the bypass outlet 106 and is opened to discharge fluids to the outside of the body 100 through the bypass outlet 106 when a pressure in the low pressure side fluid supply groove 101 is increased more than a predetermined pressure.

The bypass outlet 106 discharges fluids inside the low pressure side fluid supply groove 101 to the storage tank T.

The relief valve 107 blocks fluids which moved to the bypass outlet 106 from being discharged to the outside of the body 100 and performs an opening/closing operation by raising the pressure in the low pressure side fluid supply groove 101 to discharge the fluids to the outside of the body 100 through the bypass outlet 106.

When a predetermined pressure is applied, the relief valve 107 performs an opening/closing operation to pass fluids, and the pressure at which the opening/closing operation is performed may be adjusted by a user.

The body 100 further includes a fluid flow controller 110 which is formed between the fluid guide path 105 and the fluid outlet 104 to communicate with the high and low pressure side fluid guide paths 102*a* and 101*a* and supplies fluids to the high and low pressure side fluid guide paths 102*a* and 101*a* or guides fluids discharged from the high and low pressure side fluid supply grooves 102 and 101 through the high and low pressure side fluid guide paths 102*a* and 101*a* to be discharged through the fluid outlet 104.

The fluid flow controller 110 includes a first flow path 111 through which the fluid guide path 105 and the high and low pressure side fluid guide paths 102*a* and 101*a* communicates with each other, a second flow path 112 through which the first flow path 111 and the fluid outlet 104 communicates with each other, a blocking ball 113 which is inserted into the first flow path 111 to open and close the first flow path 111, and an elastic spring 114 which is inserted into the second flow path 112 and presses the blocking ball 113 such that the blocking ball 113 seals the first flow path.

The first flow path 111 guides fluids inside the fluid guide path 105 to be supplied to the high and low pressure side fluid guide paths 102*a* and 101*a*.

The second flow path 112 guides fluids discharged through the high and low pressure side fluid guide paths 102*a* and 101*a* to be discharged to the outside of the body 100 through the fluid outlet 104.

The blocking ball 113 is inserted into and coupled to the first flow path 111 not to be interfered with the high and low pressure side fluid guide paths 102*a* and 101*a* and opens the first flow path 111 by moving out of the first flow path 111 while pressing the elastic spring 114 using a suction pressure suctioned to the high and low pressure side fluid guide paths 102*a* and 101*a*

The blocking ball 113 blocks the first flow path 111 by being pressurized in the direction of the first flow path 111 by a pressure of fluids discharged to the high and low pressure side fluid guide paths 102*a* and 101*a* and the restoring force of the elastic spring 114.

The elastic spring 114 presses the blocking ball 113 moved out of the first flow path 111 to return the blocking ball 113 to the original position.

The piston 200 is inserted into and coupled to the high and low pressure side fluid supply grooves 102 and 101 and ascends and descends along the high and low pressure side fluid supply grooves 102 and 101 to supplies fluids to the high and low pressure side fluid supply grooves 102 and 101 or pushes fluids inside the high and low pressure side fluid supply grooves 102 and 101 to the fluid outlet 104.

It is preferable that the piston 200 be formed to have an upper end with a diameter greater than that of the lower end to correspond to the shape of the high and low pressure side fluid supply grooves 102 and 101.

The piston 200 ascends/descends using the handle.

The piston 200 ascends/descends and generates a suction pressure and a pressurizing pressure in the high and low pressure side fluid supply grooves 102 and 101.

The handle 300 in a rod shape is rotatably installed between the low pressure side fluid supply grooves 101 of the body 100 and has an outer surface coupled to the pistons 200 to alternately and repeatedly pump the pistons 200.

The handle 300 is gripped and operated by a user.

The hydraulic double-acting hand pump having a structure as described above according to the embodiment of the present invention is used as follows.

First, the body 100 is pressed against and fixed to the top surface of the storage tank T where fluids are stored, and a hose (not shown) is connected between the fluid inlet 103 of the body 100 and the storage tank T.

Then, the piston 200 is inserted into and coupled to the high and low pressure side fluid supply grooves 102 and 101 of the body 100 which vertically communicate with each other and are symmetrically formed in a pair, and an upper end of the piston 200 is coupled to an outer surface of the handle 300.

Here, the handle 300 is rotatably installed between the low pressure side fluid supply grooves 101 of the body 100, and the pair of pistons 200 are alternately and repeatedly moved upward and downward.

Next, a hose (not shown) which guides discharge of fluids is connected to the fluid outlet 104 of the body 100, and a movement is repeated in which the handle 300 is pressurized downward or is raised upward with the handle 300 gripped.

Figure 4:
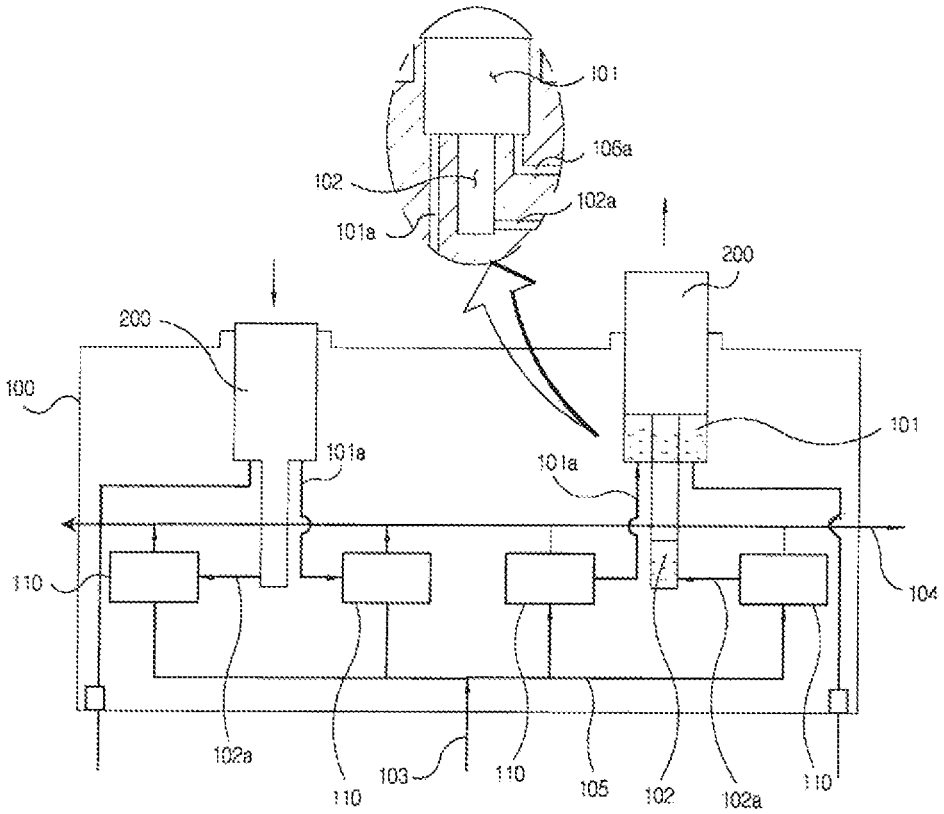
FIGS. 4 and 5 are diagrams illustrating an operation of a fluid flow of the hydraulic double-acting hand pump according to the embodiment of the present invention.
Figure 5:
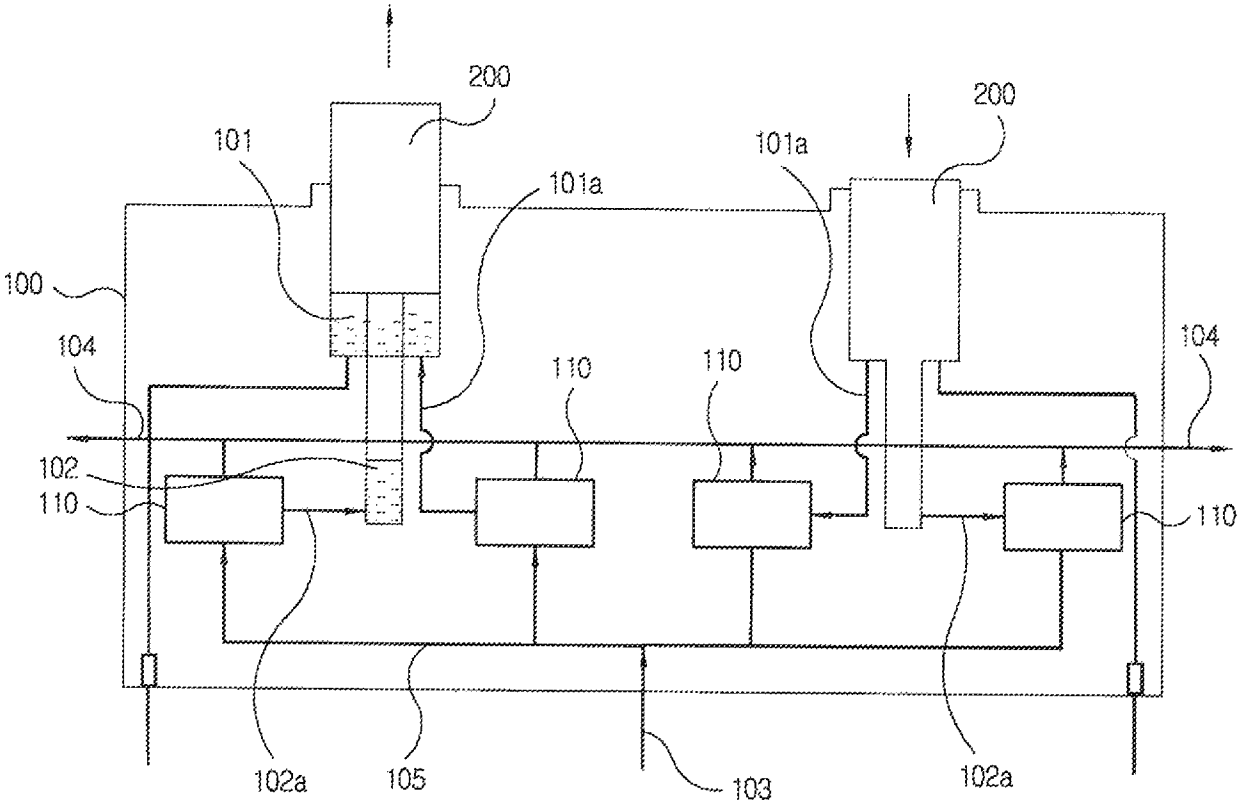

Then, referring to FIGS. 4 and 5, any one of the pistons 200 connected to the outer surface of the handle 300 is moved to the high and low pressure side fluid supply grooves 102 and 101 of the body 100, and the other piston 200 is exposed above the high and low pressure side fluid supply grooves 102 and 101.

At this point, the piston 200 which moves downward generates a pressurizing pressure in the high and low pressure side fluid supply grooves 102 and 101, and fluids inside the high and low pressure side fluid supply grooves 102 and 101 are pushed by the pressurizing pressure of the piston 200 to be discharged through the high and low pressure fluid guide paths 102*a* and 101*a*.

Figure 7A:
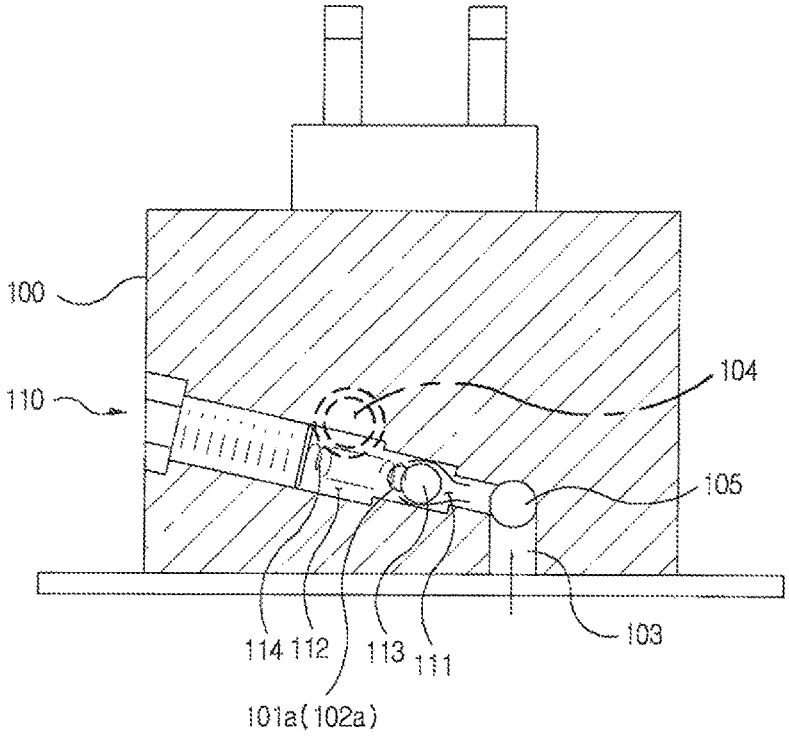
FIGS. 7*a* and 7*b* are diagrams Illustrating operation of a fluid flow controller of the hydraulic double-acting hand pump according to the embodiments of the present invention.
Figure 7B:
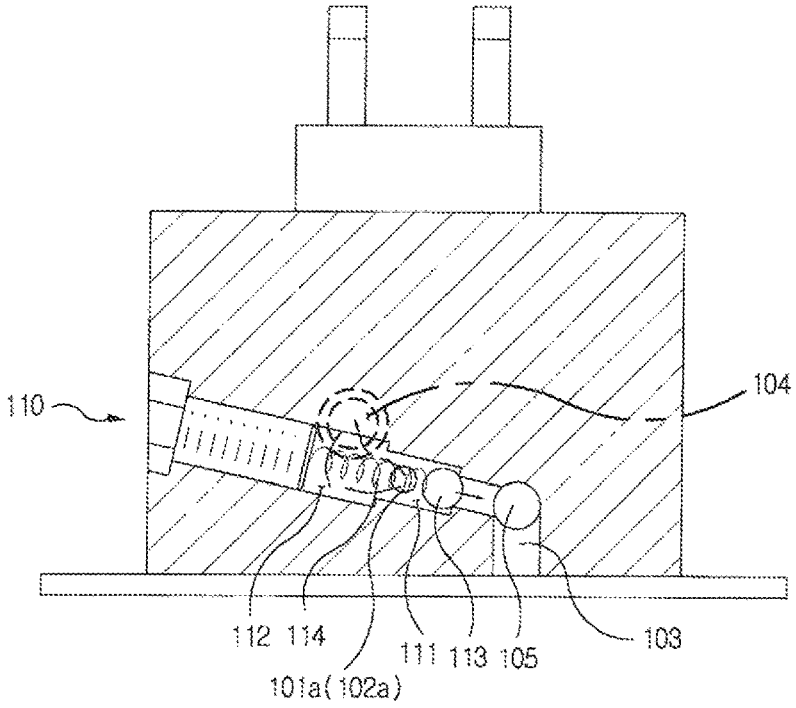

Here, referring to FIG. 7B, the fluids discharged through the high and low pressure fluid guide paths 102*a* and 101*a* are moved to the first flow path 111 of the fluid flow controller 110 and presses the blocking ball 113 in a direction of the first flow path 111.

At this point, the blocking ball 113 is pressurized by the fluids discharged by the high and low pressure fluid guide paths 102*a* and 101*a* and the elastic spring 114 and is moved in the direction of the first flow path 111.

Accordingly, simultaneously with the first flow path 111 being blocked by the blocking ball 113, the fluids are moved to the second flow path 112 in communication with the first flow path 111, and at this point, the fluids moved to the second flow path 112 are discharged to the outside of the body 100 through the fluid outlet 104.

On the other hand, the piston 200 which moves upward generates a suction pressure in the high and low pressure side fluid supply grooves 102 and 101, and fluids stored in the storage tank T are supplied to the inside of the body 100 through the fluid inlet 103 by the suction pressure.

Then, the fluids supplied to the inside of the body 100 through the fluid inlet 103 pass through the fluid guide path 105 and the fluid flow controller 110, are moved to the high and low pressure side fluid guide paths 102*a* and 101*a*, and are supplied to the insides of the high and low pressure side fluid supply grooves 102 and 101 through the high and low pressure side fluid guide paths 102*a* and 101*a*.

Here, referring to FIG. 7A, simultaneously with receiving the fluids through the first flow path 111, the fluid flow controller 110 pushes the blocking ball 113 in a direction of the second flow path 112 to open the first flow path 111.

At this point, the blocking ball 113 is pushed from the first flow path 111 and opens the first flow path 111 while pressing the elastic spring 114.

Next, the fluids moved to the open first flow path 111 are supplied to the high and low pressure side fluid supply grooves 102 and 101 through the high and low pressure side fluid guide paths 102*a* and 101*a* in communication with the first flow path 111.

That is, as described above, by the pistons 200 which alternately and repeatedly ascend and descend to generate a suction pressure or pressurizing pressure in the high and low pressure side fluid supply grooves 102 and 101 of the body 100, fluids are supplied to the inside of the high and low pressure side fluid supply grooves 102 and 101, or fluids in the high and low pressure side fluid supply grooves 102 and 101 are discharged through the fluid outlet 104 of the body 100.

Figure 6:
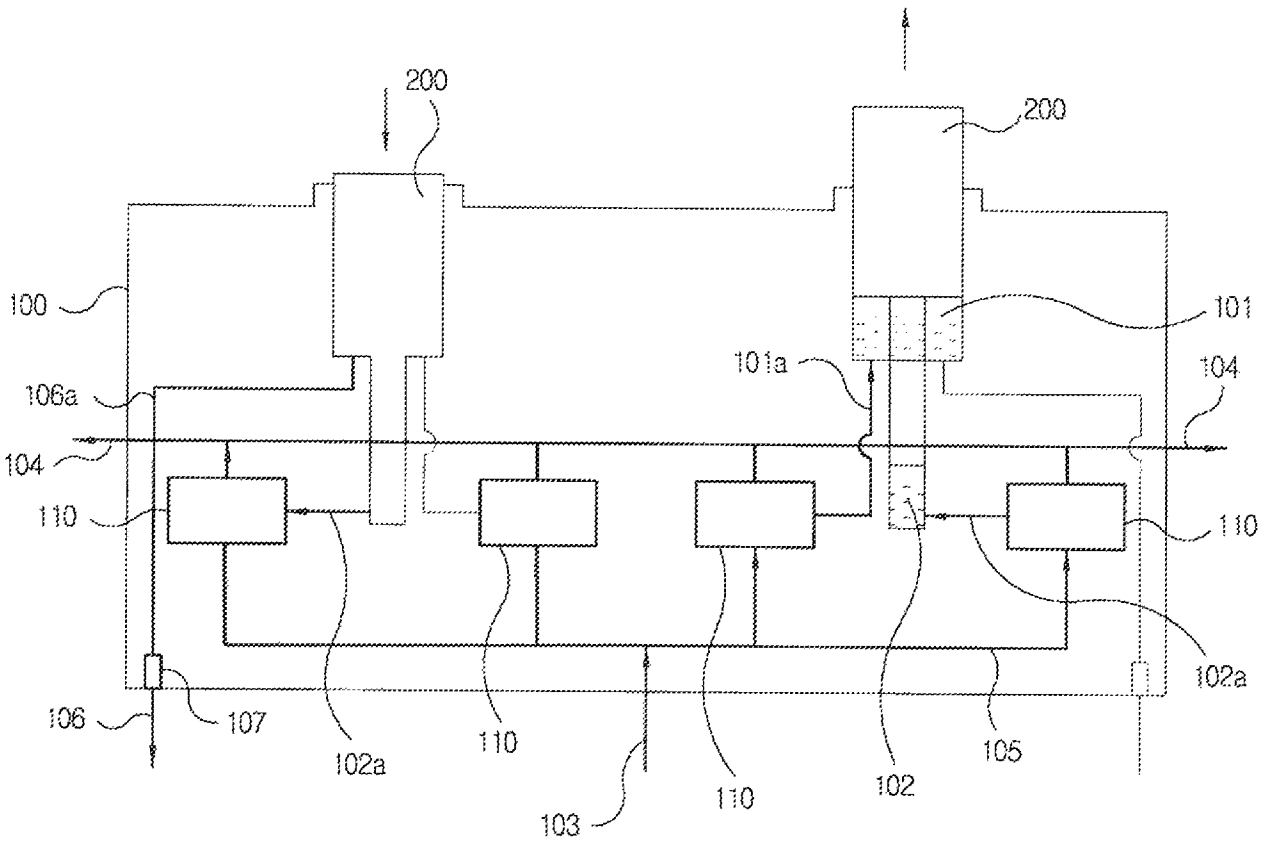
FIG. 6 is a diagram illustrating an operation of a fluid flow where the fluids in a low pressure side fluid supply groove in the hydraulic double-acting hand pump according to the embodiment of the present invention are bypassed.

Meanwhile, referring to FIG. 6, when fluids in the high and low pressure side fluid supply grooves 102 and 101 are pushed by the descending piston 200, a part of the fluids in the high and low pressure side fluid supply grooves 102 and 101 is moved to the bypass outlet 106 through the bypass path 106*a*, and at this point, the relief valve 107 installed in the bypass outlet 106 blocks the fluids from being discharged to the outside of the body 100 through the bypass outlet 106.

Here, when a pressure in the low pressure side fluid supply groove 101 is increased by the piston 200, the fluids in the bypass path 106*a* press the relief valve 107 by the pressure, and at this point, the relief valve 107 is pressurized by the pressure which is more than a predetermined pressure such that the relief valve 107 is opened and the fluids are discharged to the outside of the body 100 through the bypass outlet 106.

At this point, the fluids discharged to the outside of the body 100 are added back into the storage tank T.

In the above-described structure in which the pair of pistons 200 are alternately and repeatedly moved upward and downward by the handle 300 so that fluids are suctioned into the high and low pressure side fluid supply grooves 102 and 101 or fluids in the high and low pressure side fluid supply grooves 102 and 101 are discharged through the fluid outlet 104, a user pumps the handle 300 to operate the pair of pistons 200 at the same time such that supply and discharge of fluids simultaneously occur, and when the fluids are discharged and a pressure in the low pressure side fluid supply groove 101 is increased to be greater than a predetermined pressure, the relief valve 107 is opened to bypass the fluids inside the low pressure side fluid supply groove 101 to the storage tank T, the pressure in the low pressure side fluid supply groove 101 is decreased by bypassing of the fluids inside the low pressure side fluid supply groove 101, a pressure applied to the handle 300 is rapidly decreased by a decrease in the pressure, and thus the user may easily pump the handle 300.

According to the embodiment of the present invention, a user pumps the handle to operate the pair of pistons at the same time to simultaneously supply and discharge fluids, and when the fluids are discharged and a pressure in the low pressure side fluid supply groove is increased to be greater than a predetermined pressure, the relief valve is opened to bypass fluids inside low pressure side fluid supply groove to the storage tank T, the pressure in the low pressure side fluid supply groove is decreased by bypassing of the fluids inside the low pressure side fluid supply groove, a pressure applied to the handle is rapidly decreased by a decrease in the pressure, and thus the user may easily pump the handle. Accordingly, there is an advantage in that a user easily pushes fluids inside the high pressure side fluid supply groove to sequentially push the fluids through the fluid outlet such that the reliability of a product is improved.

The above-described hydraulic double-acting hand pump according to the embodiment of the present invention is not limited to the above-described embodiment, and the technical sprit covers a range in which the embodiment may be variously modified and practiced by those skilled in the art without departing from the gist of the present invention defined by the appended claims.

What is claimed is:

1. A hydraulic double-acting hand pump comprising:

a body (100) installed on a top surface of a storage tank (T), wherein a pair of low pressure side fluid supply grooves (101) which receive fluids are formed to be recessed in a top surface of the body (100), high pressure side fluid supply grooves (102) in communication with the pair of low pressure side fluid supply grooves (101), each of the high pressure side fluid grooves (101) is formed under a respective one of the pair of low pressure side fluid supply grooves (101) and has a smaller diameter than a diameter of the respective one of the pair of low pressure side fluid supply grooves (101), a fluid inlet (103) is formed on a bottom surface of the body (100) and communicates with the high and low pressure side fluid supply grooves (102 and 101) to receive fluids from the storage tank (T) and to supply the fluids to the high and low pressure side fluid supply grooves (102 and 101), and at least one fluid outlet (104) in communication with the high and low pressure side fluid supply grooves (102 and 101) formed at both a one surface and an other surface of the body (100) to guide the fluids inside the high and low pressure side fluid supply grooves (102 and 101) to be discharged outside of the body;

a pair of pistons (200), wherein each piston is inserted into a corresponding high and low pressure side fluid supply grooves (102 and 101) and ascend and descend along the corresponding high and low pressure side fluid supply grooves (102 and 101) to supply fluids to the corresponding high and low pressure side fluid supply grooves (102 and 101) or push fluids inside the corresponding high and low pressure side fluid supply grooves (102 and 101) to the fluid outlet (104), the pair of pistons alternatively ascend and descend to simultaneously draw fluids into the body and discharge fluids out of the body; and a handle (300) in a rod shape which is pivotally installed between the pair of low pressure side fluid supply grooves (101) of the body (100), wherein the handle is coupled to the pistons (200) to alternately and repeatedly pump the pistons (200);

wherein the body (100) comprises:

a fluid guide path (105) formed to horizontally penetrate in a direction from the one surface to the other surface of the body (100) and to perpendicularly communicate with the fluid inlet (103);

a low pressure side fluid guide path (101*a*) formed between the low pressure side fluid supply groove (101) and the fluid guide path (105) to guide fluids inside the fluid guide path (105) to the low pressure side fluid supply groove (101); and a high pressure side fluid guide path (102*a*) formed between the high pressure side fluid supply groove (102) and the fluid guide path (105) to guide fluids inside the fluid guide path (105) to the high pressure side fluid supply groove (102); and a fluid flow controller (110) which is formed between the fluid guide path (105) and the fluid outlet (104) to communicate with the high and low pressure side fluid guide paths (102*a* and 101*a*) and supplies fluids to the high and low pressure side fluid guide paths (102*a* and 101*a*) and guides fluids discharged from the high and low pressure side fluid supply grooves (102 and 101) through the high and low pressure side fluid guide paths (102*a* and 101*a*) to be discharged through the fluid outlet (104).

2. The hydraulic double-acting hand pump of claim 1, wherein the body (100) further includes:

a bypass outlet (106) formed at a bottom surface of the body (100);

a bypass path (106*a*) formed between the bypass outlet (106) and the low pressure side fluid supply groove (101) to guide fluids inside the low pressure side fluid supply groove (101) to the bypass outlet (106); and a relief valve (107) installed in the bypass outlet (106) and configured to be opened to discharge fluids to the outside of the body (100) through the bypass outlet (106) when a pressure in the low pressure side fluid supply groove (101) is increased more than a predetermined pressure.

3. The hydraulic double-acting hand pump of claim 1, wherein the fluid flow controller (110) includes:

a first flow path (111) through which the fluid guide path (105) and the high and low pressure side fluid guide paths (102*a* and 101*a*) communicate with each other;

a second flow path (112) through which the first flow path (111) and the fluid outlet (104) communicate with each other;

a blocking ball (113) which is inserted into the first flow path (111) and opens and closes the first flow path (111); and an elastic spring (114) which is inserted into the second flow path (112) and presses the blocking ball (113) such that the blocking ball (113) seals the first flow path.

* * * * *